US009139896B2

(12) United States Patent
Chandra et al.

(10) Patent No.: US 9,139,896 B2
(45) Date of Patent: Sep. 22, 2015

(54) HEAT-INSULATING PROTECTIVE LAYER FOR A COMPONENT LOCATED WITHIN THE HOT GAS ZONE OF A GAS TURBINE

(75) Inventors: Sharad Chandra, Oberhausen (DE); Norbert Czech, Dorsten, DE (US)

(73) Assignee: MAN Diesel & Turbo SE, Augsburg (DE)

( * ) Notice: Subject to any disclaimer, the term of this patent is extended or adjusted under 35 U.S.C. 154(b) by 2054 days.

(21) Appl. No.: 12/084,726

(22) PCT Filed: Nov. 7, 2006

(86) PCT No.: PCT/EP2006/010655

§ 371 (c)(1), (2), (4) Date: Jul. 3, 2008

(87) PCT Pub. No.: WO2007/054265

PCT Pub. Date: May 18, 2007

(65) Prior Publication Data

US 2009/0011260 A1 Jan. 8, 2009

(30) Foreign Application Priority Data

Nov. 8, 2005 (DE) ..... 10 2005 053 531

(51) Int. Cl.

*B32B 15/00* (2006.01)
*C23C 10/02* (2006.01)
*C23C 28/00* (2006.01)

(52) U.S. Cl.

CPC ..... *C23C 10/02* (2013.01); *C23C 28/321* (2013.01); *C23C 28/325* (2013.01); *C23C 28/3215* (2013.01); *C23C 28/345* (2013.01); *C23C 28/3455* (2013.01); *Y10T 428/31678* (2015.04)

(58) Field of Classification Search

USPC ..... 416/223 R, 241 R, 241 B; 428/615, 621, 428/632, 655, 668, 680

See application file for complete search history.

(56) References Cited

U.S. PATENT DOCUMENTS

| | | | | | |
|---|---|---|---|---|---|
| RE32,121 | E | * | 4/1986 | Gupta et al. | 428/656 |
| 4,933,239 | A | * | 6/1990 | Olson et al. | 428/557 |
| 5,268,238 | A | * | 12/1993 | Czech et al. | 428/678 |
| 5,273,712 | A | * | 12/1993 | Czech et al. | 420/40 |
| 2004/0180233 | A1 | * | 9/2004 | Stamm | 428/680 |

FOREIGN PATENT DOCUMENTS

| | | |
|---|---|---|
| EP | 0 441 095 | 8/1991 |
| EP | 0 937 786 | 8/1999 |

* cited by examiner

*Primary Examiner* — Mark Ruthkosky
*Assistant Examiner* — Daniel J Schleis
(74) *Attorney, Agent, or Firm* — Cozen O'Connor

(57) ABSTRACT

Disclosed is a heat-insulating protective layer for a component located within the hot gas zone of a gas turbine. Said protective layer is composed of an adhesive layer, a diffusion layer, and a ceramic layer which is applied to the high temperature-resistant basic metal of the component. The adhesive layer comprises a metal alloy [MCrAlY (M=Ni, Co)] containing Ni, Co, Cr, Al, Y, the diffusion layer is produced by calorizing the adhesive layer, and the ceramic layer is composed of ZrO2 which is partially stabilized by means of yttrium oxide. One or several chemical metal elements that have a large atomic diameter and are selected among the group comprising Re, W, Si, Hf, and/or Ta are alloyed to the material of the adhesive layer. The adhesive layer has the following chemical composition after being applied: Co 15 to 30 percent, Cr 15 to 25 percent, Al 6 to 13 percent, Y 0.2 to 0.7 percent, Re up to 5 percent, W up to 5 percent, Si up to 3 percent, Hf up to 3 percent, Ta up to 5 percent, the remainder being composed of Ni.

5 Claims, 2 Drawing Sheets

HEAT-INSULATING PROTECTIVE LAYER FOR A COMPONENT LOCATED WITHIN THE HOT GAS ZONE OF A GAS TURBINE

CROSS REFERENCE TO RELATED APPLICATIONS

This is a U.S. national stage of International Application No. PCT/EP2006/010655, filed on 7 Nov. 2006. Priority is claimed on German Application No. 10 2005 053 531.3, filed on 8 Nov. 2005.

BACKGROUND OF THE INVENTION

1. Field of the Invention

The invention relates to a heat-insulating protective layer and, more particularly, to a heat-insulating protective layer for a component within the hot-gas section of a gas turbine.

2. Description of the Related Art

In modern gas turbines, almost all of the surfaces in the hot-gas section of the turbine are provided with coatings. Exceptions to this may still be found in the turbine blades in the rear of a turbine blade array. The heat-insulating layers serve to lower the material temperature of the cooled components. As a result, the service life of the components can be extended, cooling air can be reduced, or the gas turbine can be operated at higher inlet temperatures. Heat-insulating layer systems in gas turbines always consist of a metallic bonding layer which is diffusion bonded to the base material, on top of which a ceramic layer with poor thermal conductivity is applied, which provides the actual barrier against the heat flow and protects the base metal of the component against high-temperature corrosion and high-temperature erosion.

Zirconium oxide ($ZrO_2$, zirconia) has become widely accepted as the ceramic material for the heat-insulating layer, which is almost always partially stabilized with approximately 7 wt.% of yttrium oxide (international abbreviation: "YPSZ" for "Yttria Partially Stabilized Zirconia"). Here, the heat-insulating layers are divided into two basic classes, depending on how they are applied. The first class comprises thermally sprayed layers (usually applied by the atmospheric plasma spray (APS) process), in which, depending on the desired layer thickness and stress distribution, a porosity of approximately 10-25 vol.% in the ceramic layer is produced. Binding to the (raw sprayed) bonding layer is accomplished by mechanical interlocking. The second class comprises layers which are deposited by the EB-PVD (Electron Beam Plasma Vapor Diffusion) process, which, when certain deposition conditions are observed, have a columnar or a columnar elongation-tolerant structure. Here, the layer is bound chemically by the formation of an Al/Zr-mixed oxide on a layer of pure aluminum oxide, which is formed by the bonding layer during the application process and then during actual operation (Thermally Grown Oxide, TGO). This imposes very strict requirements on the growth of the oxide on the bonding layer.

In principle, either diffusion layers or cladding layers can be used as bonding layers.

The list of requirements on the bonding layers is complex and includes the following conditions which must be taken into account: i) low static and cyclic oxidation rates; ii) formation of the purest possible aluminum oxide layer as TGO (in the case of EB-PVD); iii) sufficient resistance to high-temperature corrosion; iv) low ductile-brittle transition temperature; v) high creep resistance; vi) physical properties similar to those of the base material, good chemical compatibility; vii) good adhesion; viii) minimal long-term interdiffusion with the base material; and ix) low cost of deposition in reproducible quality.

For the special requirements in stationary gas turbines, bonding or cladding layers based on MCrAlY (M=Ni, Co) offer the best possibilities for fulfilling the chemical and mechanical conditions. MCrAlY layers contain the intermetallic β-phase NiCoAl as an aluminum reserve in a NiCoCr ("γ") matrix. The β-phase NiCoAl, however, also has an embrittling effect, so that the Al content which can be realized in practice is ≤12 wt. %. To achieve a further increase in the oxidation resistance, it is possible to coat the MCrAlY layers with an Al diffusion layer. Because of the danger of embrittlement, this is limited in most cases to starting layers with a relatively low aluminum content (Al≤8%).

The structure of an alitized MCrAlY layer consists of the inner, extensively intact γ, β-mixed phase, a diffusion zone, in which the Al content rises to ~20%, and an outer layer with a β-NiAl phase, with an Al content of about 30%. This outer layer with a NiAl phase represents the weak point of the layer system with respect to brittleness and crack sensitivity.

In addition to the oxidation properties and the mechanical properties, the (inter)diffusion phenomena between the base material and the MCrAlY layer— in specific cases also between the MCrAlY layer and the alitized Layer— become increasingly more important with respect to service life as the service temperature increases. In extreme cases, the diffusion-based loss of aluminum in the MCrAlY layer can exceed the loss caused by oxide formation. Through asymmetric diffusion, in which the local losses are greater than the supply of fresh material, defects and pores can form and, in the extreme case, the layer can delaminate.

SUMMARY OF THE INVENTION

It is therefore an object of the invention to avoid the above-described disadvantages and, in the case of a heat-insulating protective layer of the general type in question, to slow down diffusion without negatively influencing the oxidation properties of the alitized layer or the ductility and creep resistance of the layer system.

These and other objects and advantages are achieved in accordance with the invention by a heat-insulating protective layer for a component which is located within a hot-gas section of a gas turbine engine.

BRIEF DESCRIPTION OF THE DRAWINGS

The invention is explained in more detail below using an exemplary embodiment with reference to two figures, in which.

DETAILED DESCRIPTION OF THE EXEMPLARY EMBODIMENTS

It is known that the rate of diffusion can be slowed down through the modification of the specially composed NiCo CrAlY bonding layer by preferably adding not only Re but also by adding W, Si, Hf, and/or Ta in the indicated concentration. The service life of the heat-insulating protective layer, i.e., the layer deposited by EB-PVD, is significantly extended by the increased resistance to diffusion to the base material and to the built-up alitized layer. In the event of premature failure of the heat-insulating protective layer 100 as a result of, for example, impact by a foreign body or erosion, a relatively long period of "emergency operation" remains possible. Such a heat-insulating layer is shown in FIG. 1.

Figure 1:
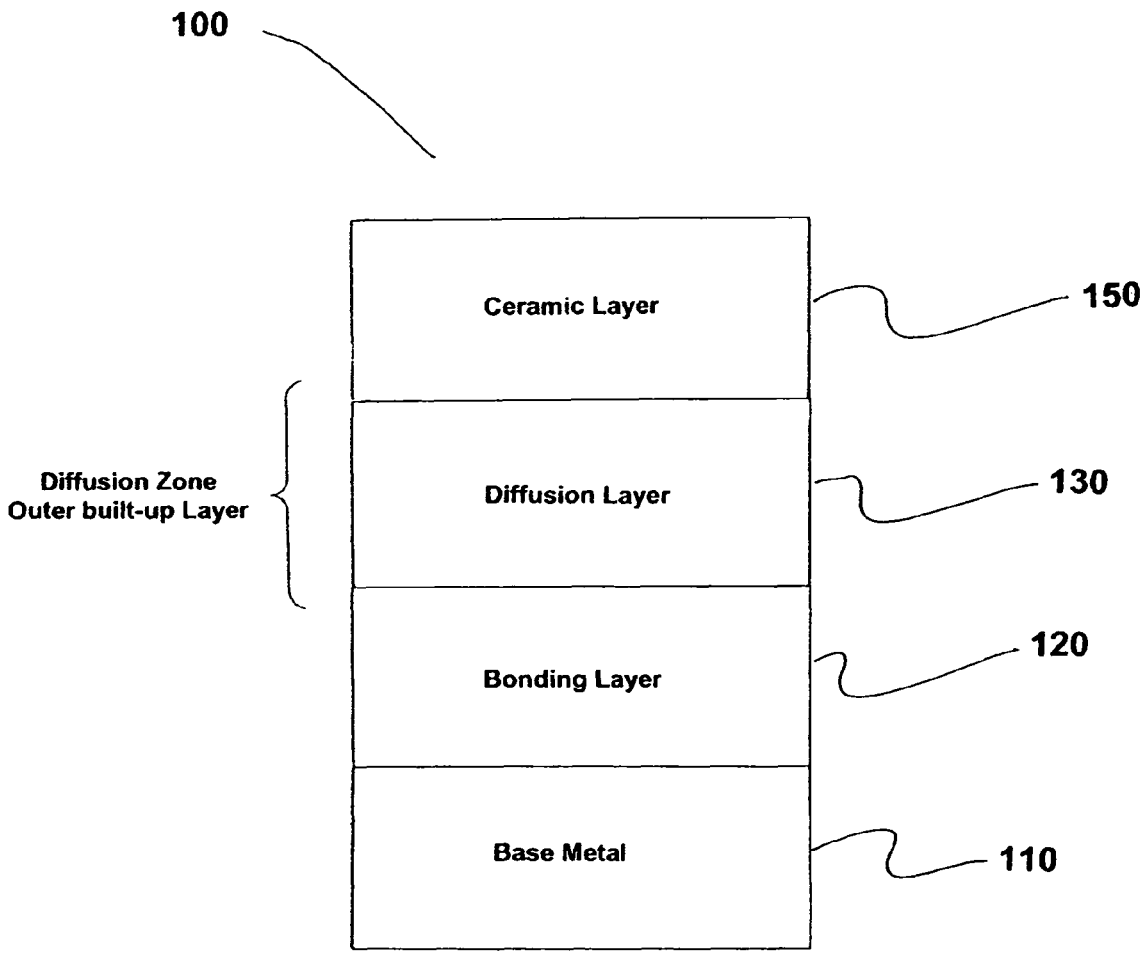
FIG. 1 shows a schematic illustration of the heat-insulating protective layer in accordance with the invention.
Figure 2:
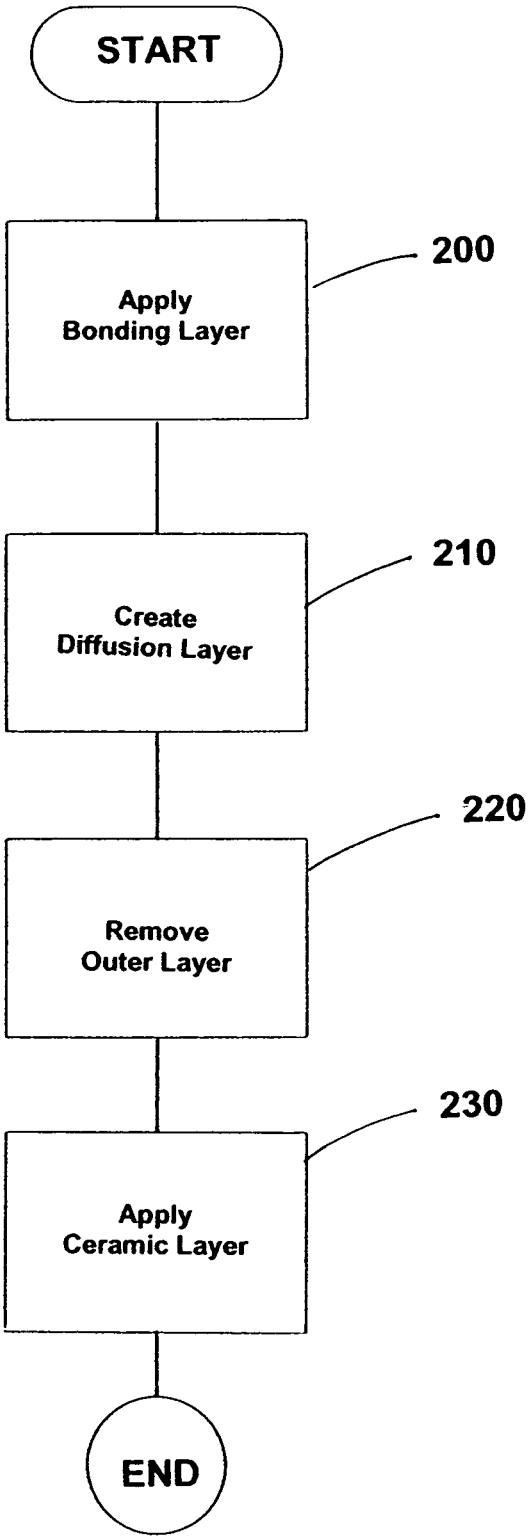
FIG. 2 is a flow chart illustrating the step of the method in accordance with the invention.

With reference to FIGS. 1 and 2, the heat-insulating protective layer 100 of the invention is produced in the following manner. A bonding layer 120 is applied onto the base metal 110 of a cooled component in the hot-gas section, such as a blade of a gas turbine, by a process such as thermal spraying, as indicated in step 200. For this purpose, an atomized prealloyed powder with the following chemical composition is used: Co 15-30 wt.%, Cr 15-25 wt.%, Al 6-13 wt.%, Y 0.2-0.7 wt.%, with the remainder consisting of Ni. One or more of the elements Re up to 5 wt.%, W up to 5 wt.%, Si up to 3 wt.%, Hf up to 3 wt, and Ta up to 5 wt.% are added to the alloyed powder. The powder used thus preferably has the following chemical composition: Co 25 wt.%, Cr 21 wt.%, Al 8 wt.%, Y 0.5 wt.%, Re 1.5 wt.%, with the remainder consisting of Ni. After application, the bonding layer has the chemical composition of the powder which was used.

After the bonding layer 120 has been applied, the bonding layer 120 is coated or the surface is alitized to create an Al diffusion layer 130 to increase the Al content, as indicated in step 210. The coating of the bonding layer 120 is accomplished by alitizing the surface, i.e., by utilizing a treatment in which, at elevated temperatures, a reactive Al-containing gas, usually an Al halide ($AlX_2$), causes an inward-diffusion of Al in association with an outward-diffusion of Ni.

When the surface is alitized in this way, an inner diffusion zone is formed within the diffusion layer 130 on the extensively intact bonding layer 120, and on top of that an outer built-up layer of a brittle β-NiAl phase is formed. In accordance with a process described in German Patent Application 10 2004 045 049.8, this outer built-up layer is removed down to the inner diffusion zone of the diffusion layer 130 by blasting it with hard particles, such as corundum, silicon carbide, tiny metal wires, or other known grinding or polishing agents, as indicated in step 220. The abrasive treatment is continued until the surface of the remaining diffusion layer 130 has an Al content of more than 18% and less than 30%.

After one of the previously cited processes, the ceramic layer 150 of yttrium oxide-stabilized zirconium oxide is finally applied, as indicated in step 230.

Thus, while there are shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice.

What is claimed is:

1. A heat-insulating protective layer for a component which is to be located within a hot-gas section of a gas turbine, comprising:

a bonding layer having a Ni, Co, Cr, Al, Y-containing metal alloy, wherein the Ni, Co, Cr, Al, Y-containing metal alloy is MCrAlY, where M=Ni, Co, to which one or more chemical-metal elements with a large atomic diameter selected from the group consisting of Re, W, Si, Hf and Ta are added as alloys such that the bonding layer applied to a high temperature-resistant base metal of the component has a chemical composition in accordance with: Co 15-30 wt. %, Cr 15-25 wt. %, Al 6-13 wt. %, Y 0.2-0.7 wt. %, Re up to 5 wt. %, W up to 5 wt. %, Si up to 3%, Hf up to 3 wt. %, Ta up to 5 wt. %, with a remainder consisting of Ni;

a diffusion layer; and a ceramic layer, the diffusion layer arranged between the ceramic layer and the bonding layer;

wherein the bonding layer, diffusion layer and ceramic layer are applied to the high temperature-resistant base metal of the component;

wherein the diffusion layer is produced by alitization of the bonding layer in that a surface of the bonding layer on the base metal is alitized to form a surface-alitized MCrAlY layer that has a structure consisting of an inner, extensively intact γ, β-mixed phase, the diffusion layer consisting of an inner diffusion zone with an Al content of about 20%, and an outer built-up layer consisting of a β-NiAl phase with an Al content of about 30 wt. %, the outer built-up layer being removed essentially down to the inner diffusion zone of the diffusion layer by an abrasive treatment such that a surface of the diffusion layer has an Al content of more than 18 wt. % and less than 30 wt. %.

2. The heat-insulating protective layer according to claim 1, wherein Re is added as an alloy to the Ni, Co, Cr, Al, Y-containing metal alloy of the bonding layer, so that the bonding layer, after application, has a chemical composition in accordance with: Co 25 wt. %, Cr 21 wt. %, Al 8 wt. %, Y 0.5 wt. %, Re 1.5 wt. %, with the remainder consisting of Ni.

3. The heat-insulating protective layer according to claim 1, wherein the ceramic layer consists of $ZrO_2$ and is partially stabilized with yttrium oxide.

4. The heat-insulating protective layer according to claim 1, wherein the bonding layer comprises a Ni, Co, Cr, Al, Y-containing metal alloy.

5. The heat-insulating protective layer according to claim 1, wherein the ceramic layer consists of $ZrO_2$ and is partially stabilized with yttrium oxide.

* * * * *